US005287998A

United States Patent [19]

Smrt

[11] Patent Number: 5,287,998

[45] Date of Patent: Feb. 22, 1994

[54] ACTUATOR FOR AEROSOL CONTAINERS

[75] Inventor: Thomas J. Smrt, Marengo, Ill.

[73] Assignee: Fox Valley Systems, Inc., Cary, Ill.

[21] Appl. No.: 987,583

[22] Filed: Dec. 8, 1992

Related U.S. Application Data

[63] Continuation of Ser. No. 700,540, May 15, 1991, abandoned.

[51] Int. Cl.[5] ..... B65D 83/20

[52] U.S. Cl. ..... 222/402.1; 222/402.13; 222/608; 239/150; 239/337

[58] Field of Search ..... 222/402.1, 402.13, 402.15, 222/402.22, 507, 608; 239/150, 273, 337

[56] References Cited

U.S. PATENT DOCUMENTS

| | | | |
|---|---|---|---|
| 3,485,206 | 12/1969 | Smrt | 118/305 |
| 3,700,144 | 10/1972 | Smrt | 222/176 |
| 3,796,353 | 3/1974 | Smrt | 222/176 |
| 3,817,429 | 6/1974 | Smrt | 222/402.22 |
| 3,871,557 | 3/1975 | Smrt | 222/162 |
| 4,126,273 | 11/1978 | Smrt | 222/181 X |
| 4,262,821 | 4/1981 | Smrt | 222/162 |
| 4,396,153 | 8/1983 | Smrt | 239/337 |
| 4,946,104 | 8/1990 | Smrt | 239/150 |

FOREIGN PATENT DOCUMENTS

| | | |
|---|---|---|
| 372441 | 2/1983 | Austria . |
| 2045318 | 10/1980 | United Kingdom . |

OTHER PUBLICATIONS

European Search Report, Application No. 92304431.7-, dated Sep. 8, 1992.

*Primary Examiner*—Andres Kashnikow
*Assistant Examiner*—J. A. Kaufman
*Attorney, Agent, or Firm*—Leydig, Voit & Mayer, Ltd.

[57] ABSTRACT

An actuator for use with an aerosol container, the actuator having a passage therethrough which terminates in an orifice, the passage being configured such that the contents of the aerosol container may be communicated through the passage and discharged from the actuator at the orifice, comprising an actuator body, and one or more pairs of wings secured to the body, each wing having a bottom edge located proximate to the orifice and peripheral edges which are adjacent to and intersect the bottom edge, wherein at least a portion of the peripheral edge of at least one of the wings, from a point wherein said edge intersects the bottom edge of its respective wing, angles away from the body. There is further provided a base adapted for accepting such an aerosol container actuator.

21 Claims, 5 Drawing Sheets

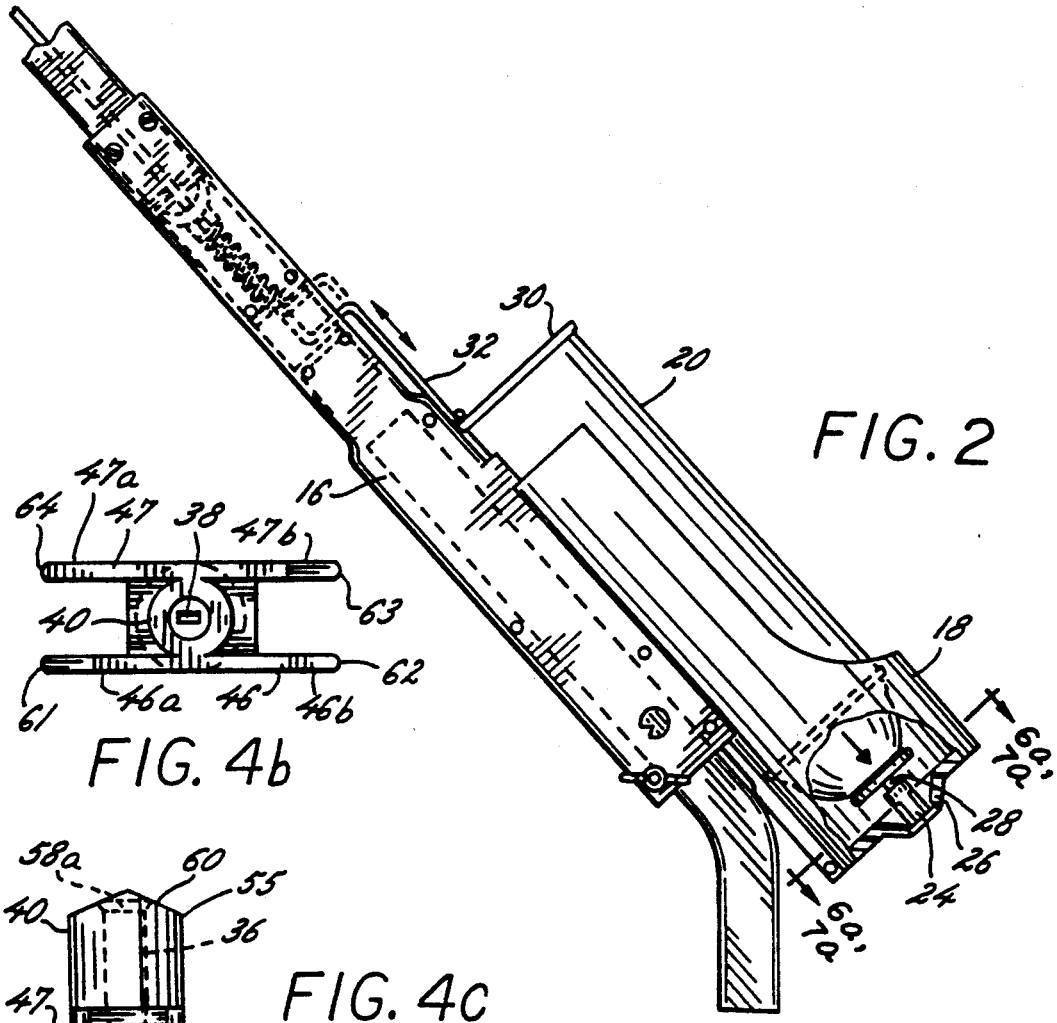
FIG. 2
FIG. 4b
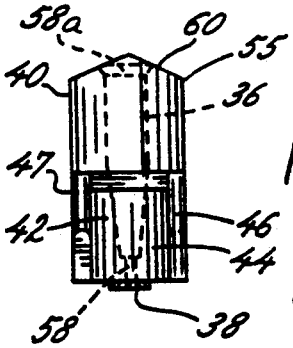
FIG. 4c
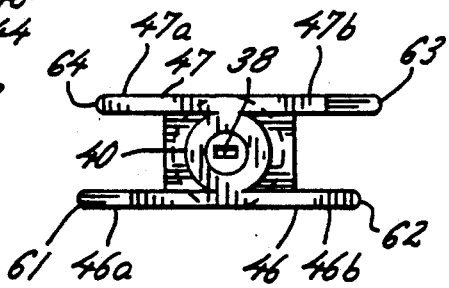
FIG. 4d
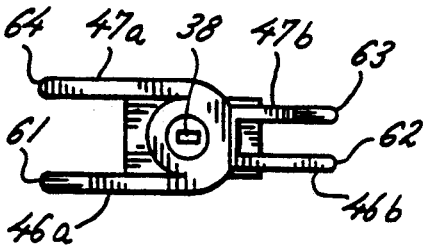
FIG. 4e
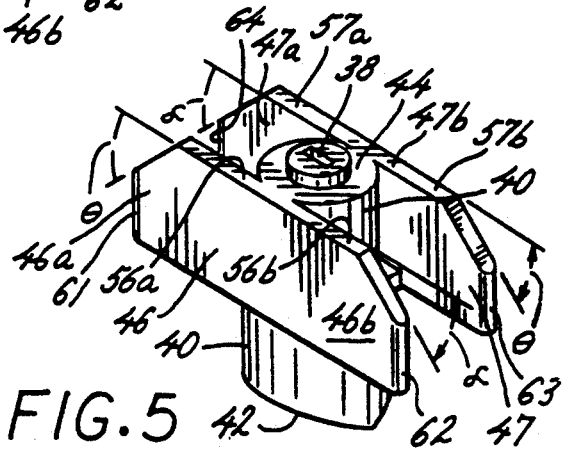
FIG. 5

ACTUATOR FOR AEROSOL CONTAINERS

This is a continuation of copending application(s) Ser. No. 07/700,540 filed on May 15, 1991 now abandoned.

FIELD OF THE INVENTION

This invention relates generally to actuators for use in effecting the discharge of compositions from aerosol containers. More particularly, the present invention relates to actuators for aerosol containers, which containers are intended for use with maneuverable marking devices such as parking lot line stripers.

BACKGROUND OF THE INVENTION

Maneuverable marking devices, which are well known in the art, are commonly used for a variety of purposes, e.g., for the striping or line marking of a variety of surfaces. For example, such devices have been used to mark the location of a property line, underground pipes or cables, planting areas for nursery stock as well as boundaries of athletic fields. Additional, and more common, uses of such marking devices are the application of marks in the form of stripes to delineate parking spaces, walkways, and the like.

Many currently available spraying devices use aerosol containers or cans as the sole source of marking material. Upon preparing to use one of these devices, an operator will typically insert the aerosol can into the device in an inverted configuration. Such positioning allows the orifice of the actuator to direct the marking material onto the surface over which the device will be subsequently propelled.

Devices which utilize the aforesaid aerosol containers are especially economical where the particular marking application is relatively small. Such economy arises primarily from the fact that a pressure source, e.g., an air compressor, is not required to effect discharge of the marking material from its source.

Moreover, such marking devices provide further advantages at the time the supply of marking material in a particular can is exhausted. For example, an empty can may simply be removed from the device and a new can inserted in its place. Such a procedure eliminates the need for clean-up of the marking material delivery system, as is typically required when a non-aerosol can-based marking device is employed.

The foregoing, as well as other advantages, e.g., ease of use, low initial start-up costs, and low maintenance costs, have made marking devices which employ aerosol cans as their source of marking material a very popular design.

Although hand-held marking devices are typically used for non-critical applications, it is generally recognized that a marking device which is wheeled along the surface to be marked is preferable for applications where a relatively high degree of accuracy is desired. However, unless the orifice is centered with regard to the device, as well as to the mark which is to be applied, it will be difficult to produce a consistently uniform mark. For example, if the orifice is not centered, one edge of the mark may receive less marking material than the opposite side, resulting in a non-uniform mark.

One method which has been employed to enhance the uniformity achieved when attempting to produce a wide mark, e.g., a parking lot stripe, is the use of an actuator orifice which is generally slotted, or rectangular, in shape. In such cases, the widest portion of the slot is oriented perpendicular to the direction of movement of the spraying device. Such orientation allows for wide, and uniform, distribution of the marking material across the width of the mark.

The above adoption of a slotted orifice does not, however, completely remedy the problem of non-uniformity. More specifically, such does not ensure that the orifice will be centered with regard to the device. One actuator design which attempts to address this centering, and therefore uniformity, problem is disclosed in U.S. Pat. No. 4,396,153. The '153 patent discloses an actuator for an aerosol can having two pairs of flexible and resilient wings which extend outwardly from opposing sides of the actuator body. Upon insertion of an aerosol can having such an actuator into a base on the marking device which has been designed to accept such an actuator, the wings engage inclined side walls of the base such that the rectangular actuator orifice is aligned perpendicular to the direction of travel of the marking device. If desired, the corners of the wings may be rounded in order to facilitate the insertion and alignment of the actuator.

In order for the actuator disclosed in the '153 patent to function as intended, however, the lateral dimensions of the wings must be precisely set so as to fit within the dimensions of the base. For example, if the lateral dimension of the wings are in excess of the optimum, the wings will not fit securely onto the base of the device. On the other hand, if the wings are too small, the actuator, and hence the orifice, will not be securely positioned on the base, this resulting in the orifice not being centered on the base. In summary, then, an oversized actuator will not be able to fit within the confines of the base thereby rendering the device inoperable, while an undersized actuator will result in the production of less than the highest quality marks due to the movement of the orifice about the base.

Accordingly, a need exists for an actuator and spraying device which will simply and inexpensively compensate for any under or oversizing of the actuator or of any dimensional irregularities present in the base of the marking device.

SUMMARY OF THE INVENTION

There has now been developed an actuator for use with an aerosol container, the actuator having a passage therethrough which terminates in an orifice, the passage being configured such that the contents of the aerosol container may be communicated through the passage and discharged from the actuator at the orifice, comprising an actuator body, and at least one pair of wings secured to the body, each wing having a bottom edge located proximate to the orifice and a peripheral edge which is adjacent to and intersects the bottom edge. At least a portion of the peripheral edge of at least one wing, from a point wherein said peripheral edge intersects the bottom edge of its respective wing, angles away from the body.

There is further provided a base adapted for accepting an aerosol container actuator and residing on a movable marking device, the base having a bottom wall and an opening therein through which the contents of an aerosol container may be discharged, said base comprising at least one inclined planar surface located on one side of the opening which surface diverges upwardly with respect to the bottom wall and outwardly with respect to the opening, the inclined surface terminating at an inclined side wall which has an angle of inclination with respect to the bottom wall which is greater than the angle of the inclined surface.

When an aerosol container having the aforedescribed actuator is inserted into a compatible holder of a marking device, the inclined surfaces function in combination with the actuator wings to align the preferred rectangular spraying orifice perpendicular to the intended direction of travel of the spraying device. The blocks located on the base of the holder and side walls also assist in this function. Furthermore, and in accordance with the invention, the angled edge of one or more of the wings, in conjunction with the inclined surfaces of the holder, functions to automatically laterally center the rectangular orifice with regard to the opening in the base, regardless of any dimensional imperfections present in the base and/or wings.

BRIEF DESCRIPTION OF THE DRAWINGS

FIG. 2 is a side view of the aerosol container shown in FIG. 1 in which the aerosol container is positioned in a handle of the marking device.

FIG. 4*b* is a bottom view of the actuator taken along line 4*b*—4*b* of FIG. 4*a*.

FIG. 4*c* is a side view of the actuator shown in and taken along line 4*c*—4*c* of FIG. 4*a*, wherein a flow passage within the actuator is shown in phantom.

FIG. 4*d* is a bottom view of a third embodiment of an actuator wherein the non-angled portions of the wings are shorter than the angled portions of the wings.

FIG. 4*e* is a bottom view of yet another embodiment of an actuator of the present invention wherein each wing in a wing pair does not lie in the same plane.

FIG. 5 is a perspective view of an actuator configured in accordance with a second embodiment of the present invention.

DETAILED DESCRIPTION OF THE PREFERRED EMBODIMENTS

In accordance with the present invention, there is provided an actuator which is suitable for effecting the discharge of the contents of an aerosol container onto a surface as well as a base capable of receiving this actuator. Upon integration of the actuator and base into a movable marking device, the present invention further provides for the production of a uniform mark on a desired surface irrespective of the dimensional imperfections associated with either the actuator or the base.

Figure 1:
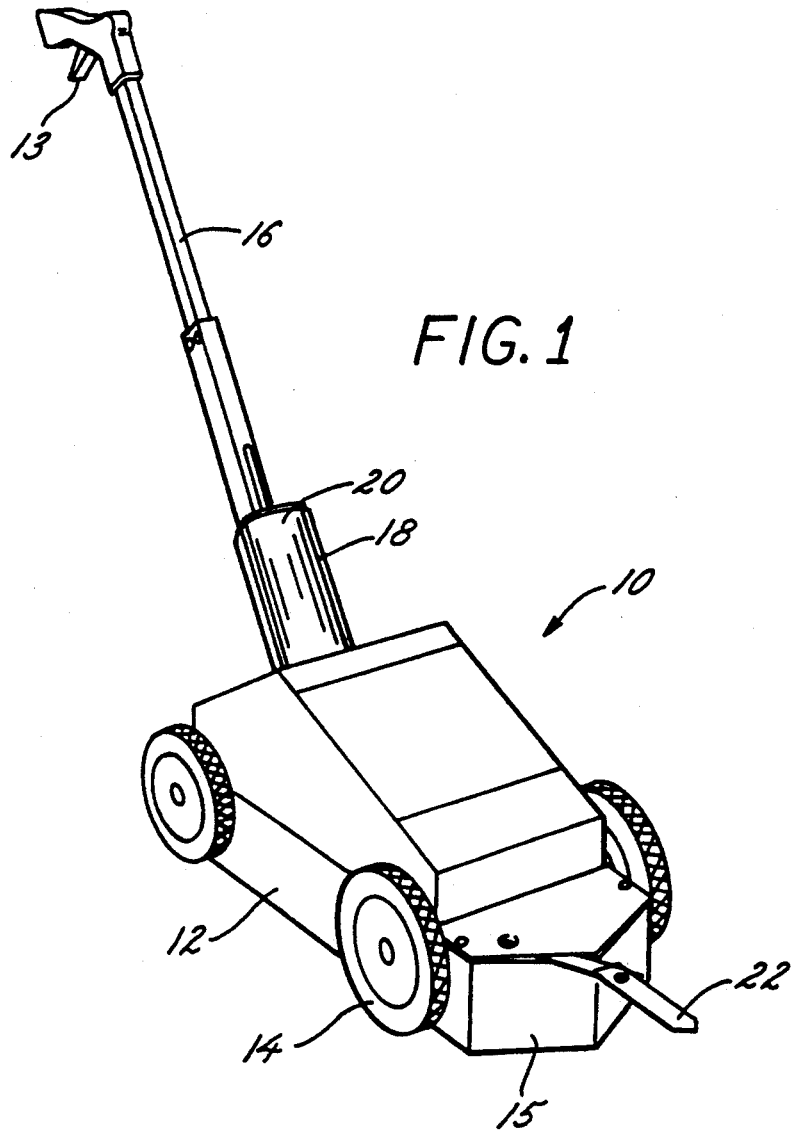
FIG. 1 is a perspective view of a maneuverable marking device including an aerosol marking container, wherein the marking device and the aerosol container are capable of accepting an actuator configured in accordance with the present invention.

Turning initially to FIG. 1, there is disclosed a marking device 10 having wheels 14 affixed thereto which allow movement of the device over a surface along a substantially linear path. Such device generally comprises a housing 12 and a handle 16. As a convenience, a pointer 22 may also be included on the device 10, this assisting an operator in moving the device along a desired path. Further, a counterbalancing member 15 may also be advantageously appended to the device 10 to assist in, as the name implies, counterbalancing the downward force applied to the handle by the operator when maneuvering the device. Without such counterbalancing, the downward force associated with the pushing of the device by the operator during maneuvering tends to lift the front wheels 14 from the surface, thus allowing the device to stray from its intended course. A more detailed description of such a counterbalancing member, as well as the advantages inherent therein, may be found in U.S. Pat. No. 4,946,104.

The handle 16 itself, although previously described as a means by which an operator may maneuver the device, also provides a means by which the discharge of the contents of an aerosol container may be effected. More specifically, the handle 16 includes a holder 18 which is configured to receive, and secure therein, an aerosol container 20. FIG. 2, which is an enlarged view of FIG. 1, illustrates such a container 20 mounted securely within the holder 18. The container 20 is typically inserted and secured in an inverted position in the holder 18 such that the marking material may be applied in a downward direction, onto a surface over which the device traverses.

In order to effect a discharge of marking material from the device 10, a container 20, which includes an actuator 24, is placed into the holder 18. When inserted properly, the container 20 rests upon a support base 26 of the holder 18. An actuator rod 32, which is operated by a trigger 13 (see FIG. 1) located on an upper end of the handle assembly 16, is used to actuate, or open, an internal container valve (not shown) by forcing the bottom 30 of the container 20 towards the base 26. When the valve is open, the contents of the container 20 are forced through and out of the container 20 by the internal pressure provided by a suitable propellant located within the container 20. After the contents of the container 20 pass through the valve, they continue through a valve stem 28 and enter the actuator 24. In the actuator 24, the contents pass through a passage 36

(see FIGS. 4*a* and 4*c*) and subsequently are discharged into the atmosphere through an orifice 38 (see FIGS. 3 and 4*a*). After the contents of the can 20 pass through the orifice 38, the contents pass through an opening 41 in the base 26 (see FIG. 6*a*), through the interior of the housing 12, and onto the surface over which the marking device 10 is located.

Figure 3:
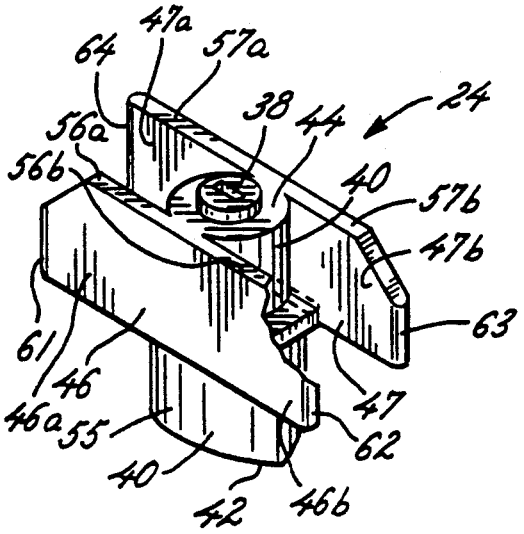
FIG. 3 is a perspective view of the actuator configured in accordance with one embodiment of the present invention, wherein a portion of the actuator is broken away so as to better illustrate the configuration of the actuator.

Referring now to FIG. 3, the actuator 24 is shown configured in accordance with one embodiment of the present invention having two pairs of wings, each pair being tangentially located on opposite sides of the body, and each pair of wings being substantially parallel to the other. The actuator 24 includes, preferably, a generally cylindrical body 40 containing a passage 36 (see FIGS. 4*a* and 4*c*) through which, as mentioned previously, the contents of the container flow upon actuation of the internal valve. A first end 42 of the body 40 is advantageously rotatably fastened to the valve stem 28 of the aerosol container 20. As illustrated in FIG. 4*c*, the first end 42 of the body 40 may be provided with beveled surfaces 60. These beveled surfaces 60 are described in detail in U.S. Pat. No. 3,817,429, this reference being hereby incorporated by reference. A second end 44 of the body 40, opposite the first end 42, provides an orifice 38 through which the contents of the container, e.g., marking material, are discharged to the atmosphere. It is through these first 42 and second 44 ends of the body 40 that a longitudinal axis of the actuator body 40 passes.

Figure 4A:
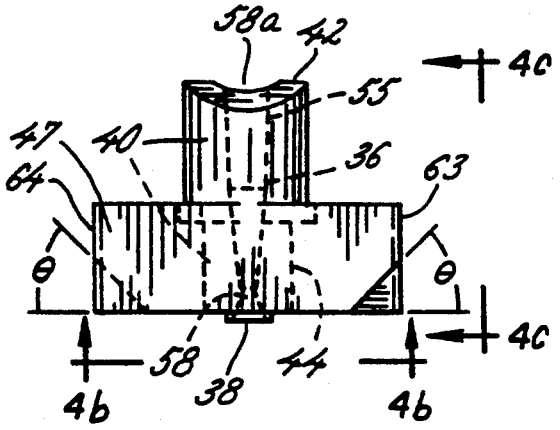
FIG. 4*a* is a side view of the actuator shown in FIG. 3, wherein the first angled edge of one wing is illustrated and a portion of the cylindrical actuator body as well as the first angled edge of the second wing are shown in phantom.

The passage 36 itself, as illustrated in phantom in FIGS. 4*a* and 4*c*, is comprised of a lower portion 58 and an upper portion **58*a*. The upper portion 58*a*, which is advantageously frustro-conical in configuration, is adapted for mounting onto the valve stem 28. The lower portion 58, which is similarly shaped into the advantageous frustro-conical configuration, terminates at a preferred rectangular, or slotted, spraying orifice 38**.

Turning now to FIG. 4*b*, it will be appreciated that this particular embodiment of the present invention is an actuator 24 having what may generally be described as an H-shaped cross section in the plane which extends generally perpendicular to the longitudinal axis of the body 40. Although the illustrated embodiments of the actuator 24 throughout most of this description contain two pairs of wings **46*a*, 46*b* and 47*a*, 47*b***, only one pair of wings is necessary, although two pairs of wings are preferred. Additional wings may be included within the actuator and used successfully, provided, of course, they are configured in accordance with and complementary to the description contained herein.

As mentioned previously, one embodiment of the present actuator 24, as illustrated in FIG. 4*b*, includes two pairs of wings **46*a*, 46*b* and 47*a*, 47*b*, which, as illustrated, are fastened tangentially to the body 40**. Although tangential attachment is preferred, it is not required. The wings may be attached on opposite sides of the body, nontangentially.

Preferably each pair of wings lies in planes which are substantially parallel with each other, i.e., they are parallel to each other within about 2° to about 5°. Again, however, it is not required that the wing pairs lie in parallel planes. Indeed, the wings may be affixed to the body in any desirable configuration. As but one alternative example, the wings may be attached to the body such that when viewed from the bottom, the cross-section may take the shape of an "X".

Each pair of wings are preferably rectangular in shape and are advantageously secured to the body 40 so that each wing is of approximately equal length. When two pairs of wings are employed, they preferably are secured on opposite sides of the body 40, with each wing of each wing pair being located in the same plane.

Alternatively, the wings may be independently secured to the body 40 so that the wings of each wing pair do not lie in the same plane. An example of such an alternative configuration is illustrated in FIG. 4*e*.

When two pairs of wings are tangentially mounted, each pair of wings will have a left wing "a" and a right wing "b", the left wing "a" being defined as the wing on the left side of the body when viewing the actuator 24 from the top with the orifice 38 horizontally aligned, and for discussion purposes it does not matter which wing is rotated to be on the right or left side. Further, each wing is terminated by a peripheral edge as illustrated in FIG. 3, i.e., each wing terminates at a peripheral wing edge 61, 62, 63, or 64.

Each of the pairs of wings 46, 47 also includes bottom edges **56*a*, 56*b* and 57*a*, 57*b***. This edge is defined as that longitudinal edge which is proximate to the orifice. In accordance with an important aspect of the present invention illustrated by FIG. 4*a*, at least a portion of the peripheral edges 61, 63 of the wings **46*a*, 47*b* from the point they intersect with the bottom edges 56*a*, 57*b* of their respective wings, angle away from the body 40**. The angle of these angled edges $\theta$, which is measured using the bottom edge as a baseline, should be less than 90° preferably between about 75° and 15°, preferably 45° or less and most preferably about 45°. Moreover, the angles for each of the wings preferably are substantially identical, i.e., within about 5° of each other.

Figure 6A:
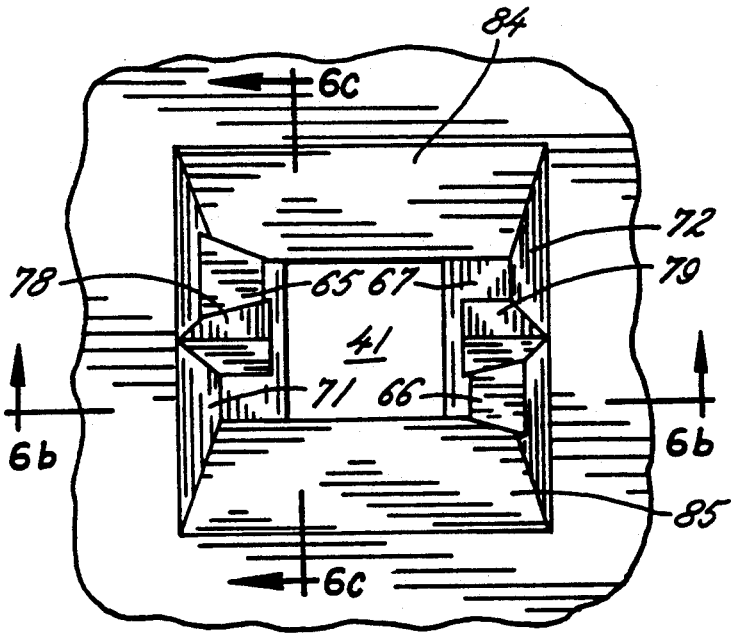
FIG. 6*a* is a fragmentary view of a base of the marking device taken along line 6*a*—6*a* of FIG. 2, wherein the actuator shown in FIG. 2 is omitted.
Figure 7A:
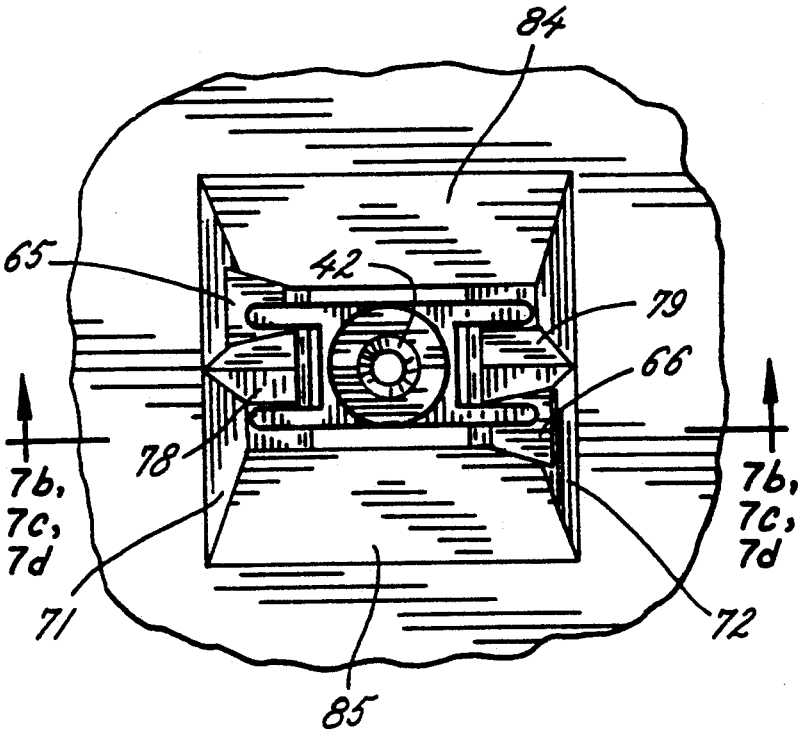
FIG. 7*a* is a fragmentary, cross-sectional view of the base and the actuator taken along line 7*a*—7*a* of FIG. 2.
Figure 6B:
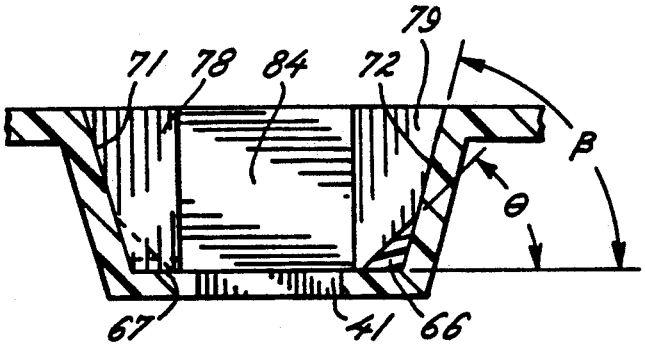
FIG. 6*b* is a cross-sectional view of the base shown in and taken along line 6*b*—6*b* of FIG. 6*a*.
Figure 7B:
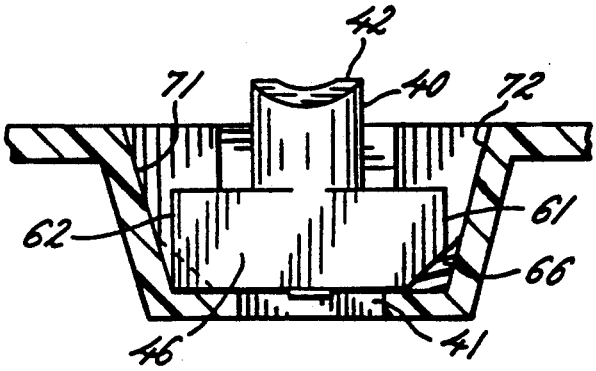
FIG. 7*b* is a cross-sectional view of the base and the actuator taken along line 7*b*—7*b* of FIG. 7*a*.
Figure 6C:
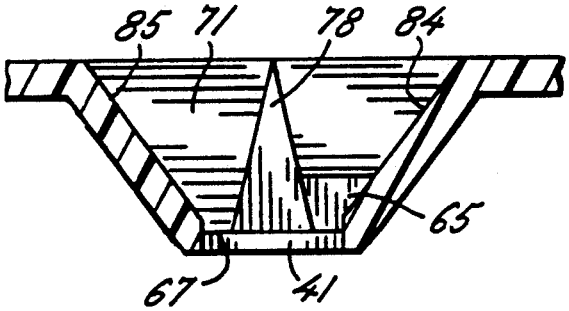
FIG. 6*c* is a cross-sectional view of the base shown in and taken along line 6*c*—6*c* of FIG. 6*a*.

Referring now to FIGS. 6–7, the base 26 of the container holder 18 includes a bottom wall 67 and an opening 41 therein through which the contents of the aerosol container may be discharged. The opening 41 may be of any configuration and size, although it should be large enough to allow the contents of the aerosol container 20 to be discharged therethrough undisturbed. Preferably, however, the opening 41 will be square or rectangular in nature.

The base 26 further comprises a first pair of inclined surfaces 65, 66 which are located on opposite sides of the opening. Such surfaces 65, 66 diverge upwardly with respect to the bottom wall 67 of the base 26 and outwardly with respect to the opening 41. The angles at which these surfaces incline upward, using the bottom of the base as a baseline, should be less than 90°, preferably between about 75° and 15°, and advantageously about 45°. While any angle less than 90° will work as intended, to obtain the full advantages associated with the self-centering aspect of the present invention, the angles $\theta$ should be, as indicated, between about 75° and 15°, preferably 45° or less, and most preferably about 45°. Moreover, these angles, i.e., of the inclined surfaces 65, 66 and peripheral edges 61, 63, are preferably substantially equal to each other, i.e., within about 5°.

Further, the first pair of inclined surfaces 65, 66 terminate at first and second inclined side walls 71, 72, respectively. The side walls 71, 72 have a greater degree of perpendicularity than the first inclined surfaces 65, 66, i.e., the angle $\theta$ of the first side walls 71, 72 is greater than that of the first inclined surfaces 65, 66, using the bottom 67 of the base 26 as a baseline. In accordance with an important aspect of the present invention, the aforesaid first inclined surfaces 65, 66 are adapted to receive the angled portions of the peripheral edges 61, 63 of the actuator 24. Thus, the aforesaid angle chosen for the inclined surfaces 65, 66 as mentioned previously, should be essentially equivalent to the corresponding angle 8 on the peripheral edges 61, 63 of the actuator wings 46, 47. When such correspondence is realized, significant advantages flow therefrom. For example, turning to FIG. 7*a*, if the actuator 24 is the correct size, i.e., the length of the wings correspond with the shortest distance between one inclined side wall 71 of the base 26 to the second inclined side wall 72 of the base 26, the actuator 24 will be securely held within the base 26. Further, and significantly, the orifice 38 will be properly centered with regard to the opening 41 in the bottom of the base 26. An illustration of such proper fit is given in FIGS. 7*a* and 7*b*.

It will also be appreciated from FIG. 6*a* that the first inclined surfaces 65, 66 preferably begin their incline from the bottom 67 of the base 26 at a predetermined distance from the opening 41, this distance between the beginning of the inclination of each surface 64, 65 corresponding to the length of the bottom edges 56*a*, 57*b* of the wings 46*a*, 47*b* of the actuator 24. If the bottom edges 56*a*, 57*b* of the actuator 24 are shortened, then the surfaces may be moved a corresponding distance closer to the opening 41 in the base 26. Of course, if the bottom edges 56*a*, 57*b* of the actuator 24 are shortened too extensively, it may be appropriate to decrease the size of the opening 41 accordingly.

Figure 7D:
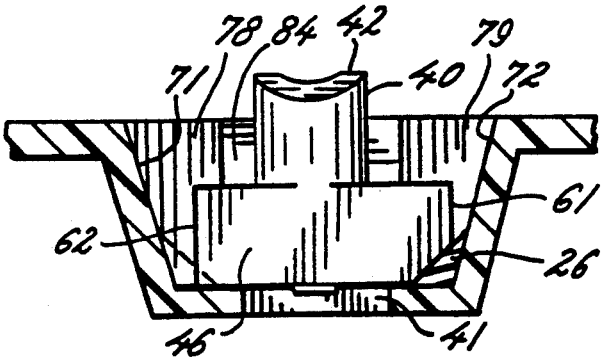
FIG. 7*d* is a cross-sectional view of the base and the actuator taken along line 7*d*—7*d* of FIG. 7*a*, wherein the wings attached to the actuator body are undersized.

If, however, the wing lengths, and hence the actuator 24, is undersized, or the base 26 is oversized, as illustrated in FIG. 7*d*, the present actuator 24 allows the orifice 38 to remain centered with respect to the opening 41 in the bottom 67 of the base 26. Moreover, the actuator 24 continues to be firmly held in the base 26 of the holder 18. This is due to the design of the actuator 24 and the base 26, more precisely, the angles $\theta$ in the peripheral edges 61, 63 of the wings 46*a*, 47*b* acting to prevent the actuator 24 from moving laterally within the base 26 despite the dimensional aberrations.

Figure 7C:
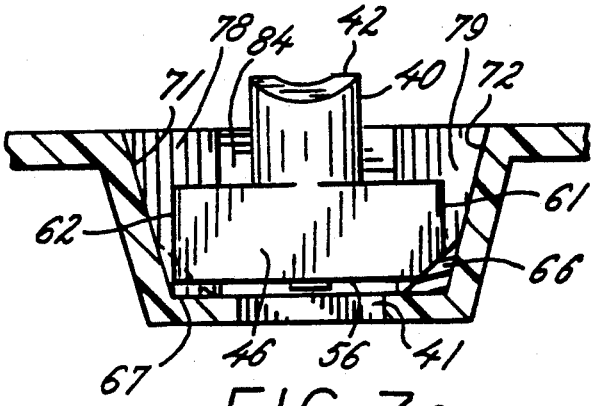
FIG. 7*c* is a cross-sectional view of the base and the actuator taken along line 7*c*—7*c* of FIG. 7*a*, wherein wings attached to the actuator body are oversized.

Alternatively, if the actuator is oversized, or the base is undersized, as exemplified by FIG. 7*c*, the actuator 24 and hence the orifice 38 will remain centered with respect to the opening 41 in the base 26. As is apparent from FIG. 7*c*, the angles $\theta$ in the peripheral edges 61, 63 of the wings 46*a*, 47*b* in coordination with the inclined surfaces of 65, 66 and the base 26, prevent the actuator 24 from moving laterally within the base 26 while allowing centering of the orifice 38 with respect to the opening 41 to occur.

In a preferred embodiment of the aforesaid actuator wherein only the peripheral edges 61, 63 are angled, the non-angled, or second edges 62, 64 are advantageously longitudinally shortened such that, if the actuator is oversized or the base is undersized, the non-angled edge will not contact the side walls 71, 72. Such will eliminate any potential detrimental effect on the centering of the orifice by the non-angled second edges 62, 64. This embodiment is exemplified in FIG. 4*d*.

Figure 8:
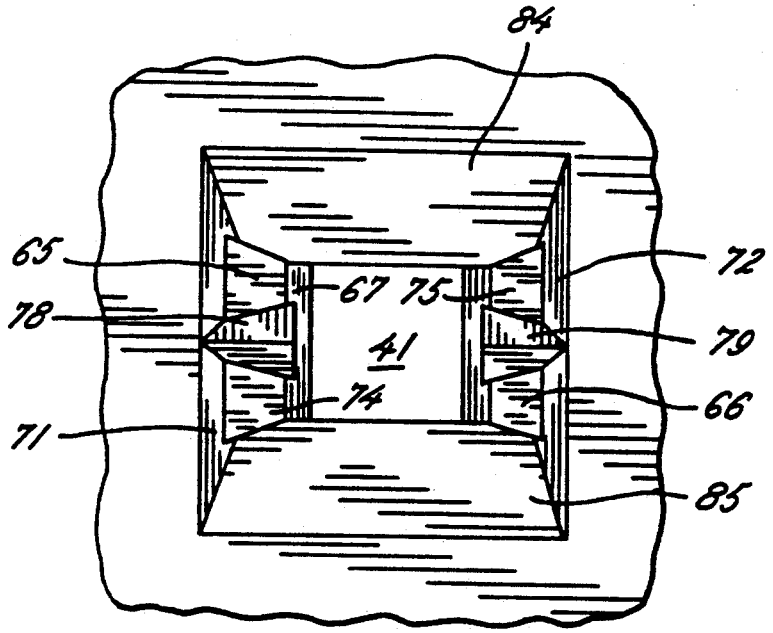
FIG. 8 is a fragmentary view of a second embodiment of the base shown in and taken along line 8—8 of FIG. 2, wherein the actuator shown in FIG. 2 is omitted.

For the aforesaid reason, another embodiment of the present invention, as illustrated in FIG. 5, provides for angling the second set of peripheral edges 62, 64 of the wings 46*b*, 47*a*. Preferably, the angle of the peripheral edges 62, 64 are approximately the same as for the peripheral edges 61, 63. In other words, angle $\alpha$ preferably is substantially equivalent to angle $\theta$ as precisely described, i.e., within about 5°. In this way, the aforesaid potential problem may be easily resolved. Of course, the bottom 67 of the base 26 will require modification to inure the full benefit associated with the angling of all peripheral edges of both wings 46, 47. It should be appreciated that the embodiment of the actuator 24 shown in FIG. 5 will function properly in combination with a base 26 having only two inclined surfaces 65 or 66 as shown in FIG. 6*a*. Of course, the embodiment shown in FIG. 5 also functions properly in a base 26 having four inclined surfaces 65, 66, 74, 75 as shown in FIG. 8.

The modification to the base to fully utilize an actuator having four angled edges will require the base 26 to further include a second pair of inclined surfaces 74, 75 which, like the first surfaces 65, 66, diverge upwardly with respect to the bottom wall 67 and outwardly with respect to the opening 41. Moreover, each of the second inclined surfaces 74, 75 should have an angle which is substantially equal to the other with respect to the bottom wall as well as to the peripheral inclined surfaces 65, 66, i.e., within about 5°.

In order to prevent the actuator from moving anteriorally or posteriorally with respect to the base, two aligning blocks 78, 79 are located on the bottom wall 67 of the base 26, the blocks being placed on opposite sides of the opening 41. It is these blocks 78, 79 which define the anterior and posterior sections of the base 26. The blocks 78, 79 are sized so as to fit between the first and second sets of wings 46*a* and 46*b* and 47*a* and 47*b* of the actuator 24, thereby preventing the previously described movement. In order to assist the wings 46*a* and 46*b* and 47*a* and 47*b* into position, each aligning block 78, 79 has an inverted V-shaped upper surface.

Moreover, and advantageously, a second set of inclined side walls 84, 85 may also be advantageously included in the base 26. These second side walls 84, 85 would intersect the first side walls 71, 72 such that an enclosure about the bottom wall 67 of the base is formed. It is this interaction of the wings 46*a*, 46*b*, 47*a*, 47*b*, inclined side walls 71, 72, 84, 85, and blocks 78, 79 which provide for increased ease of alignment of the preferred rectangular spraying orifice 38 into the proper position with respect to the direction of movement of the marking device 10, i.e., wherein the longitudinal dimension of the orifice is perpendicular to the direction of movement. For example, if the actuator 24 is inserted into the holder 18 at an improper angle, the second inclined side walls 84, 85 function to rotate the wings 46*a*, 46*b*, 47*a*, 47*b* of the actuator 24 into the proper position as the container 20 is inserted into the holder 18. It is for this reason that at least the wings are advantageously formed from a resilient and flexible material. A detailed description of this rotation procedure may be found in U.S. Pat. No. 4,396,153.

As previously mentioned, additional advantages may be obtained when the orifice is rectangular in shape and the planes of each pair of wings lie are substantially parallel to the longitudinal dimension of the orifice. In such a case, the longitudinal dimension of the orifice is aligned perpendicular to the direction of movement of the device. This material results in a relatively wide, uniform spray of marking material being evenly distributed over the intended marking area as the marking device is traversed along a surface.

Figure 9:
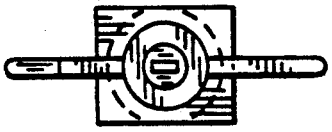
FIG. 9 is a bottom view of an actuator having a single pair of wings located centrally on the body.

Illustrated in FIG. 9 is an embodiment of the present invention employing only one pair of wings. As illustrated, the single pair of wings are centrally attached to the midpoint of the body 40, however, such a single pair of wings could likewise be attached at any useful point to the body 40, including tangentially to the top or bottom of the body 40. As illustrated, again, a pair of wings, 47*a*, 47*b*, are centrally attached to the body 40, and are in a common plane, in which the orifice, 38, also lies. Thus, the orifice, as illustrated, is in the form of a rectangular slot which lies in the same plane as wings 47*a* and 47*b*. Both wings terminate at a peripheral wing edge, 64 and 63, respectively. Further, each wing includes a bottom edge, 57*a* and 57*b*, respectively. As illustrated, at least a portion of the peripheral edge 63, of wing 47*b*, is angled, from the point where said edge 63 intersects with the bottom edge 57*b*, away from the body 40.

Figure 10:
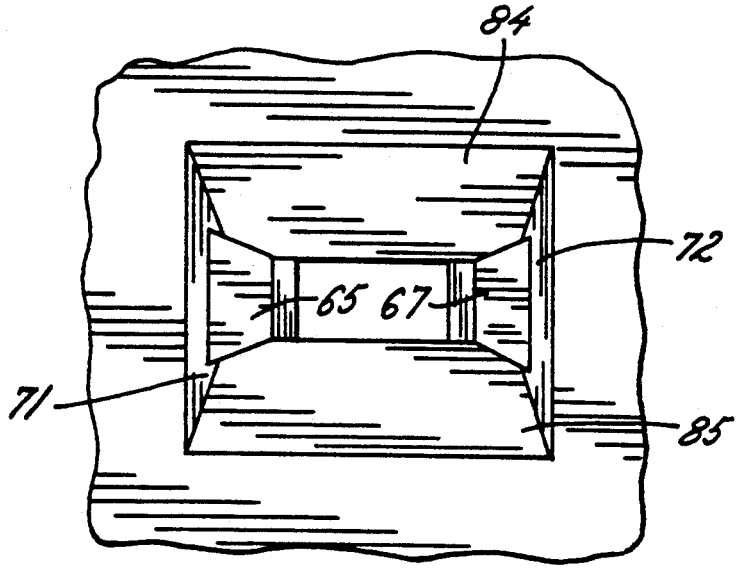
FIG. 10 is a fragmentary view of a base of a marking device designed to accommodate the actuator of FIG. 9.

FIG. 10 illustrates a complimentary base for use with an actuator as illustrated in FIG. 9. Again, the base 26 of the container holder 18 is illustrated having a bottom wall 67 and an opening 41 therein through which the contents of the aerosol container may be discharged. The base 26 further comprises an inclined surface 65 which diverges upwardly with respect to the bottom wall 67 of the base 26 and outwardly with respect to the opening 41. The angle at which the inclined surface inclines upwardly, using the bottom of the base as a baseline, again, should be less than 90°, preferably between about 75° and 15°, and advantageously about 45°. Such angles should also be employed for the angled portion of the peripheral edge 63 of the actuator illustrated in FIG. 9 in order for the actuator to most properly fit in the base 26. Also as illustrated in FIG. 10, the inclined surface 65 terminates at a side wall 71 which has a greater degree of perpendicularity than the inclined surface 65. The inclined surface 65 is thus adapted to receive the angled portion of the peripheral edge 63 of the actuator 24, as illustrated in FIG. 9.

As discussed previously, many other embodiments and configurations of both the actuator and base, all within the scope of the present invention, may be designed and effectively employed. It is intended that all such modifications and variations be within the scope of the present invention as defined by the appended claims.

We claim as our invention:

1. An actuator for use with an aerosol container, the actuator having a passage therethrough which terminates in an orifice, the passage being configured such that the contents of the aerosol container are communicated through the passage and discharged from the actuator at the orifice, comprising;

an actuator body, and;

at least one pair of wings, each wing having a bottom edge located proximate to the orifice and a peripheral edge which is adjacent to and intersects the bottom edge, wherein at least a portion of one of the peripheral edges, from a point wherein said peripheral edge intersects the bottom edge of its respective wing, angles linearly away from the body, the angle formed by the linear angled portion of a peripheral edge with respect to the bottom edge of its respective wing being less than 90 degrees.

2. The actuator of claim 1, comprising two pairs of wings wherein for each pair of wings, at least a portion of the peripheral edge of one of the wings, from the point wherein the peripheral edge intersects with the bottom edge of the wing, angles away from the body.

3. The actuator of claim 2, wherein the spraying orifice is rectangular in shape and the planes within which each pair of the wings lies are substantially parallel to the longitudinal dimension of the orifice.

4. The actuator of claim 3 wherein each pair of wings is tangentially secured to the body and said pairs of wings are substantially parallel with respect to each other.

5. The actuator of claim 1, wherein said angle ranges from about 15 to 75 degrees.

6. The actuator of claim 2, wherein said angle is about 45 degrees.

7. A base adapted for accepting an aerosol container actuator and residing on a movable marking device, the base having a bottom wall and an opening therein through which the contents of an aerosol container are discharged, said base comprising at least one inclined planar surface located on one side of the opening, which surface diverges upwardly with respect to the bottom wall and outwardly with respect to the opening, the upwardly extending inclined surface terminating at an inclined side wall which has an angle of inclination with respect to the bottom wall which is greater than the angle of the inclined surface.

8. The base according to claim 7, further comprising at least two such inclined planar surfaces, said inclined planar surfaces being located on opposite sides of the opening.

9. The base of claim 8 further comprising a pair of aligning blocks located on the bottom wall of the base on opposite sides of the opening, the blocks being arranged to define anterior and posterior sections of the base, one of the inclined surfaces being located in the posterior section of the base, the second of the inclined surfaces being located in the anterior section of the base.

10. The base according to claim 9, further comprising a second pair of inclined surfaces which diverge upwardly with respect to the bottom wall and outwardly with respect to the opening, each of the second inclined surfaces having an angle which is substantially equal to the other with respect to the bottom wall as well as to the first inclined surfaces, the second pair of inclined surfaces terminating at inclined side walls which have angles of inclination with respect to the bottom wall which are greater than the angle of the inclined surfaces, one of the second pair of inclined surfaces being located in the posterior section of the base and opposite a first inclined surface, the second of the second pair of inclined surfaces being located in the anterior section of the base and opposite a first inclined surface.

11. The base of claim 10, further comprising a handle and maneuvering the marking device, wherein the base is located on the handle.

12. A system for applying a mark onto a surface comprising an aerosol container which discharges marking material, the container having an actuator thereon, and a movable marking device, the device comprising a base having a bottom wall and an opening therein through which the marking material in the aerosol container is discharged, said base comprising a first pair of inclined planar surfaces located on opposite sides of the opening, which surfaces diverge upwardly with respect to the bottom wall and outwardly with respect to the opening, the upwardly extending inclined surfaces having substantially equal angles with respect to the bottom edge, and a pair of aligning blocks located on the bottom wall of the base on opposite sides of the opening, the blocks being arranged to define anterior and posterior sections of the base, one of the first pair of inclined surfaces being located in the posterior section of the base, the second of the first pair of inclined surfaces being located in the anterior section of the base, the actuator having a passage therethrough which terminates in an orifice, the passage being configured such that the marking material in the aerosol container is communicated through the passage and discharged from the actuator at the orifice, the actuator comprising an actuator body and two pairs of wings tangentially secured to the body such that each pair of wings lies within planes which are substantially parallel with respect to each other, each wing having a bottom edge located proximate to the orifice and peripheral edges which are adjacent to and intersect the bottom edge, wherein at least a portion of the peripheral edges, from a point wherein each of said peripheral edges intersects the bottom edge of its respective wing, angles linearly away from the body, the linear angled portion of the peripheral edge and the bottom edge of each wing defining an angle, each angle being less than 90 degrees and substantially equivalent to the other as well as to the first inclined surfaces of the base, the portion of the peripheral edge of each wing which angles away from the body at least partially contacting a corresponding first inclined surface of the base when the actuator is positioned onto the base.

13. The system according to claim 12, further comprising a second pair of inclined surfaces diverging outwardly and upwardly from the opening, each of the second inclined surfaces extending in a plane which is generally perpendicular to the direction of movement of the marking device, each of the second inclined surfaces having an angle which is substantially equivalent to the other with respect to the bottom wall and to the first inclined surfaces, each of the second inclined surfaces extending in a plane which is substantially parallel to the direction of movement of the marking device, one of the second pair of inclined surfaces being located in the posterior section of the base and opposite a first inclined surface, the second of the second pair of inclined surfaces being located in the anterior section of the base and opposite a first inclined surface.

14. The system according to claim 13, wherein at least a portion of the peripheral edges, from the point wherein each of said peripheral edges intersect with the bottom edge of its respective wing, angles away from the body, the angle-of the peripheral edge being substantially equivalent to each other.

15. The system according to claim 14, further comprising a pair of inclined side walls, wherein each of the first inclined surfaces terminate at a separate inclined side wall, the side walls having angles of inclination with respect to the bottom wall which are greater than the angle of the inclined surfaces.

16. The system according to claim 15, further comprising a second pair of inclined side walls, said second side walls intersecting with the first pair of side walls such that an enclosure about the bottom wall of the base is formed.

17. The actuator of claim 12, wherein said angle defined by the linear angled portion of the peripheral edge and the bottom edge of each wing ranges from about 15 to about 75 degrees.

18. The actuator of claim 13, wherein said angle defined by the linear angled portion of the peripheral edge and the bottom edge of each wing ranges from about 15 to about 75 degrees.

19. The actuator of claim 14, wherein said angle defined by the linear angled portion of the peripheral edge and the bottom edge of each wing is about 45 degrees.

20. A system for applying a mark onto a surface comprising an aerosol container which discharged marking material, the container having an actuator thereon, and a movable marking device, the device comprising a base which accepts the aerosol container actuator, the base comprising a bottom wall and an opening therein through which the marking material in the aerosol container is discharged and at least one inclined planar surface located on one side of the opening, which surface diverges upwardly with respect to the bottom wall and outwardly with respect to the opening, the upwardly extending inclined surface terminating at an inclined side wall which has an angle of inclination with respect to the bottom wall which is greater than the angle of the inclined surface, the actuator comprising a passage therethrough which terminates in an orifice, the passage being configured such that the contents of the aerosol container are communicated through the passage and discharged from the actuator at the orifice, an actuator body, and at least one pair of wings, each wing having a bottom edge located proximate to the orifice and a peripheral edge which is adjacent to and intersects the bottom edge, wherein at least a portion of one of the peripheral edges, from a point wherein said peripheral edge intersects the bottom edge of its respective wing, angles linearly away from the body, the angle formed by the linear angled portion of a peripheral edge with respect to the bottom edge of its respective wing being less than 90 degrees.

21. The actuator of claim 20, wherein said angle ranges from about 15 to 75 degrees.

* * * * *